US006539641B2

(12) United States Patent
Belliveau

(10) Patent No.: US 6,539,641 B2
(45) Date of Patent: Apr. 1, 2003

(54) TOOL FOR SPACING SEPARABLE OBJECTS

(76) Inventor: J. Leo Belliveau, 987 McLaughlin Dr., Moncton, New Brunswick (CA), E1G 3R3

( * ) Notice: Subject to any disclaimer, the term of this patent is extended or adjusted under 35 U.S.C. 154(b) by 0 days.

(21) Appl. No.: 09/994,716

(22) Filed: Nov. 28, 2001

(65) Prior Publication Data

US 2002/0069545 A1 Jun. 13, 2002

(30) Foreign Application Priority Data

Dec. 7, 2000 (CA) ..... 2327767

(51) Int. Cl.[7] ..... G01D 21/00
(52) U.S. Cl. ..... 33/526; 33/645
(58) Field of Search ..... 33/526, 501.05, 33/501.06, 501.08, 501.45, 518, 527, 533, 613, 645, 562, 567, 567.1

(56) References Cited

U.S. PATENT DOCUMENTS

| | | | | |
|---|---|---|---|---|
| 2,466,919 A | | 4/1949 | Sykes | |
| 2,509,236 A | | 5/1950 | Komar | |
| 2,543,716 A | | 2/1951 | Carini | |
| 2,679,745 A | | 6/1954 | Bartram | |
| 2,693,033 A | | 11/1954 | Acker et al. | |
| 2,744,334 A | | 5/1956 | Jondole | |
| 2,759,268 A | | 8/1956 | Cook | |
| 2,930,135 A | | 3/1960 | Rodtz | |
| 3,199,205 A | | 8/1965 | Halde | |
| 3,201,874 A | | 8/1965 | Christy | |
| 4,237,614 A | | 12/1980 | Williams | |
| 4,420,921 A | | 12/1983 | Hardin | |
| 4,850,114 A | | 7/1989 | Vockins | 33/526 |
| 4,930,225 A | | 6/1990 | Phillips | 33/526 |
| 4,955,142 A | | 9/1990 | Rieck | 33/526 |
| 5,148,605 A | | 9/1992 | Julia | |
| 5,163,233 A | | 11/1992 | Benson | |
| 5,190,266 A | | 3/1993 | Barrera | |
| 5,293,694 A | * | 3/1994 | Swindle | 33/527 |
| 5,481,812 A | | 1/1996 | Pedano | 33/613 |
| 5,490,334 A | | 2/1996 | Payne | 33/613 |
| 5,560,117 A | | 10/1996 | Tallman | 66/526 |
| 5,628,119 A | | 5/1997 | Bingham | 33/613 |
| 5,768,793 A | * | 6/1998 | Fields | 33/526 |
| 5,913,546 A | | 6/1999 | Kuchenbrod | |
| 6,070,336 A | | 6/2000 | Rodgers | 33/613 |
| 6,243,961 B1 | * | 6/2001 | Winski | 33/526 |

* cited by examiner

*Primary Examiner*—Christopher W. Fulton
(74) *Attorney, Agent, or Firm*—Mario Theriault

(57) ABSTRACT

The spacing tool has two spacer blades each having a hole therein, and a handle movably mounted in these holes. A gauge block is mounted to and between the spacer blades adjacent the handle. The spacing tool also has screws or other fasteners to removably retain the spacer blades to the gauge block. In the preferred embodiment, the gauge block consists of a piece of lumber from the same load or bundle of lumber as the deck boards being installed. Accurate fit of the tool over a board and accurate board spacing is therefore obtained on every project.

20 Claims, 1 Drawing Sheet

TOOL FOR SPACING SEPARABLE OBJECTS

FIELD OF THE INVENTION

This invention pertains to gauging tools used in building construction trades, and more particularly it pertains to carpenter tools for spacing pieces of lumber such as deck boards.

BACKGROUND OF THE INVENTION

Many carpenters use nails to space the boards on a deck during the construction of the deck. This is inconvenient because the nails must be held against one board until the next board is set in place. Once the board is affixed to the deck joists, the nails must be removed. Often, they are jammed between the boards and of course the heads are flush with the boards and are hard to lift up.

Other gauging tools have been developed and used in the past with varying degrees of success. Some of these tools comprise pegs or blades which are inserted between the boards and are used as substitute for the aforesaid nails. Other known tools are mounted astride a board or a stud and have guide edges which are used to set an adjacent piece of lumber. These latter tools have a standard dimension between the guide edges, or are adjustable to a standard dimension, to set pieces of lumber according to a standard spacing. Some known carpentry tools used for spacing boards, studs or other pieces of lumber are disclosed in the following documents:

U.S. Pat. No. 2,744,334 issued on May 8, 1956 to S. C. Jondole;

U.S. Pat. No. 3,201,874 issued on Aug. 24, 1965 to D. F. Christy;

U.S. Pat. No. 4,237,614 issued on Dec. 9, 1980 to J. R. Williams;

U.S. Pat. No. 4,420,921 issued on Dec. 20, 1983 to I. H. Hardin;

U.S. Pat. No. 4,850,114 issued on Jul. 25, 1989 to D. H. Vockins;

U.S. Pat. No. 4,930,225 issued on Jun. 5, 1990 to C. N. Phillips;

U.S. Pat. No. 4,955,142 issued on Sep. 11, 1990 to K. J. Rieck;

U.S. Pat. No. 5,163,233 issued on Nov. 17, 1992 to S. G. Benson;

U.S. Pat. No. 5,190,266 issued on Mar. 2, 1993 to J. Barrera;

U.S. Pat. No. 5,490,334 issued on Feb. 13, 1996 to D. Payne;

U.S. Pat. No. 5,560,117 issued on Oct. 1, 1996 to B. Tallman;

U.S. Pat. No. 5,628,119 issued on May 13, 1997 to G. A. Bingham et al.;

U.S. Pat. No. 6,070,336 issued on Jun. 6, 2000 to R. D. Rodgers;

A common drawback with some of the board spacing tools of the prior art is that the standard dimensions thereof are made for use on standard lumber widths and thicknesses. However, it is known that graded lumber can vary in dimensions from one batch to another and from one sawmill to another. Width variations in nominal 2"×6" lumber for example may be as much as ⅛ of an inch or more. Dimension variations can be attributed to sawmill machinery wear and condition, lumber dryness when planed, or other reasons. Therefore a spacing tool of the prior art which is made to mount astride a piece of lumber having a nominal width or thickness is unusable on a board which is slightly wider than the nominal width or thickness, and has a loose fit over a board which is narrower than the nominal width or thickness, thereby providing improper spacing between the boards.

As such, it may be appreciated that there continues to be a need for a new and improved board spacing tool which can be used with different batches of lumber.

SUMMARY OF THE INVENTION

The present invention provides a tool for spacing separable objects in which there is incorporated a sample of the object to be spaced. This sample is used as a reference gauge block for gauging the spacing between the separable objects during the installation of these objects.

Broadly, in accordance with one embodiment and one feature of the present invention, there is provided a board spacing tool comprising two spacer blades each having a hole therein and a handle movably mounted in these holes. A gauge block is mounted to and between the spacer blades adjacent the handle. The board spacing tool also has screws or other fasteners to removably retain the spacer blades to the gauge block. The gauge block consists of a piece of lumber from the same load or bundle of lumber as the deck boards being installed. Accurate fit of the tool over a board, and accurate board spacing is therefore obtained on every project.

Other advantages of the board spacing tool are numerous and include the facts that the tool is easy to assemble and use, and it is self-supporting once set in place. The spacer blades are retained to the handle using tube clamps which are movable along the handle for easy and quick adjustment, to suit different board widths. The handle is convenient for removing the tool from over an installed board.

Still another feature of the tool according to the present invention is that it is susceptible of a low cost of manufacture with regard to both materials and labour, and which accordingly is then susceptible of a low price of sale to the consumer, thereby making such tool economically available to the public.

Other advantages and novel features of the present invention will become apparent from the following detailed description of the preferred embodiment.

BRIEF DESCRIPTION OF THE DRAWINGS

One embodiment of the present invention in the form of a board spacing tool is illustrated in the accompanying drawings, in which like numerals denote like parts throughout the several views, and in which.

DETAILED DESCRIPTION OF THE PREFERRED EMBODIMENT

Figure 1:
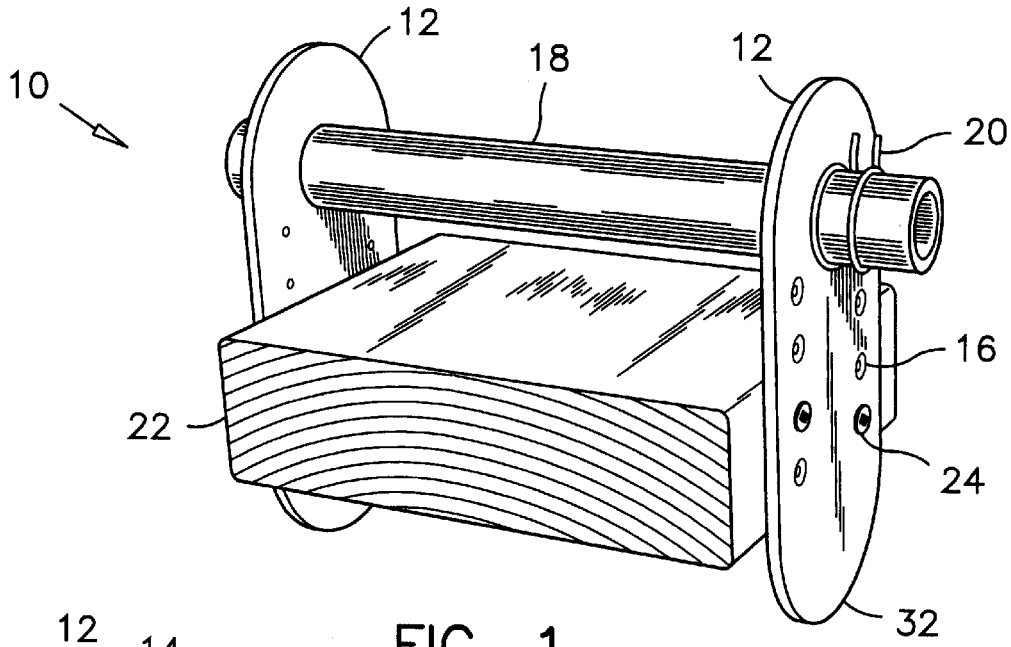
FIG. 1 is a perspective view of the board spacing tool according to the preferred embodiment of the present invention.

While this invention is susceptible of embodiment in many different forms, there is shown in the drawings and will be described in details herein one specific embodiment of the present invention, with the understanding that the present disclosure is to be considered as an example of the principles of the invention and is not intended to limit the invention to the embodiment illustrated and described.

Figure 2:
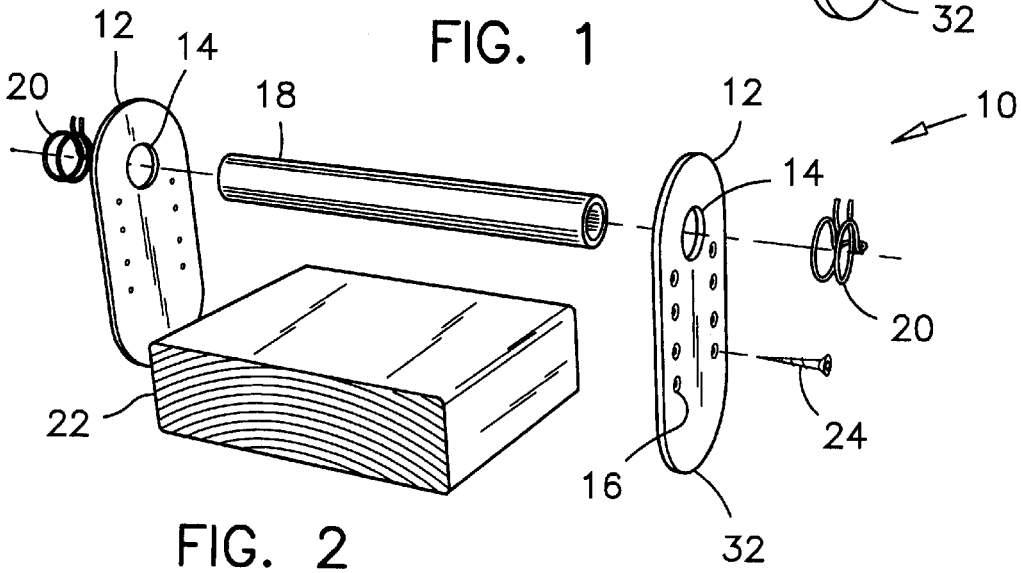
FIG. 2 is an exploded perspective view of the board spacing tool.

Referring to FIGS. 1 and 2, the board spacing tool 10 comprises two spacer blades 12 made of flat material and each having a large hole 14 therein and an array of smaller holes 16. A tubular handle 18 is inserted into the larger holes 14. The spacer blades 12 are held to the tubular handle 18 by means of two hose clamps 20 or similar clamps. Moreover, it has been found that rubber O-rings are efficient substitutes for the hose clamps, and therefore the use of the term tube clamp 20 herein comprises rubber O-rings.

A piece of lumber 22, referred to herein as a gauge block 22, is affixed to and between the blades 12 by means of screws 24 through some of the small holes 16. The gauge block 22 is preferably a short piece of lumber from a same load or bundle of lumber as the boards being installed using the board spacing tool.

Figure 3:
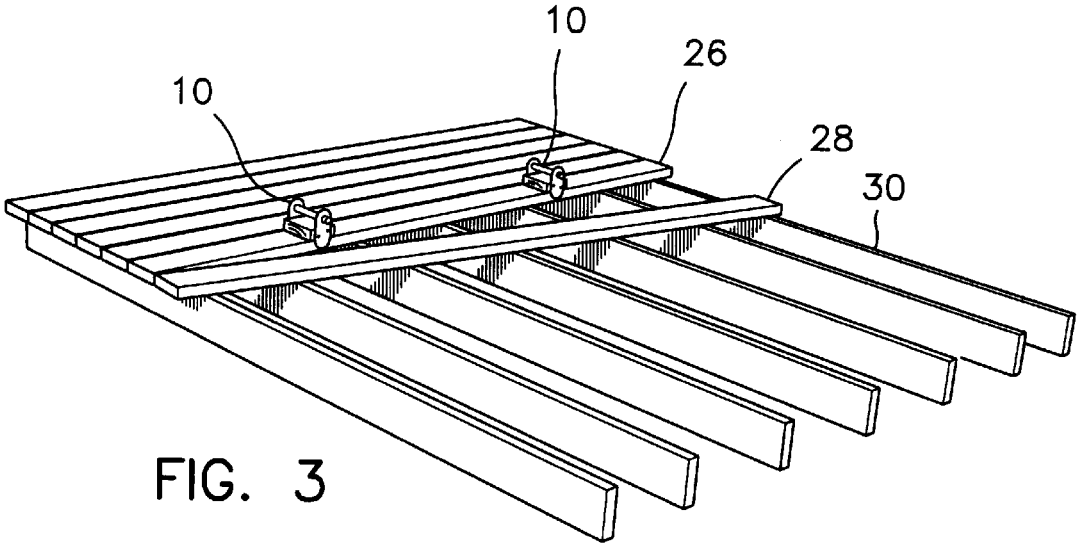
FIG. 3 is a perspective view of a deck under construction and a pair of board spacing tools in use.

This tool has advantages over the prior art spacers in that it is self-supporting. It mounts astride the last affixed board 26, with a spacer blade 12 on each side of this last-affixed board 26, as illustrated in FIG. 3. The carpenter building the deck has both hands free to bring a next board 28 in place against the exposed spacer blades 12. When that next board 28 is secured to the deck joists 30, the carpenter simply transfers the board spacing tools 10 to the board just installed, and so on until the entire deck is completed. It has been found that one person can easily build a deck using one or more board spacing tools 10, and can do so efficiently, accurately and with consistent deck board spacing.

It will be appreciated that the board spacing tool 10 can also be mounted astride the board 28 being installed to provide substantially the same advantageous results as described above.

The manufacturing of the board spacing tool 10 is relatively simple. The spacer blades 12 are made of a thin flat material such as aluminum, plastic, plywood, etc. The thickness of the blades 12 is selected to provide the required board spacing, such as ¼ of an inch for example. The spacer blades 12 are machined to cut the larger holes 14 and the array of smaller holes 16, to accommodate the mounting of the. blades 12 to gauge blocks having different thicknesses or the mounting of the spacer blades 12 at various depths relative to the bottom surface of the gauge block 22. Each of the spacer blades 12 preferably have a rounded tip 32 such that it is easily inserted between two juxtaposed boards.

The handle 18 may be made from a piece of PVC conduit or the like cylindrical hollow or solid material. The tube clamps 20 allow the adjustment of the spacer blades 12 along the handle to suit a specific gauge block width.

As mentioned before, the gauge block 22 is preferably a sample of the same decking material as the boards being installed, that is from the same load of lumber or from the same bundle of lumber. This sample provides for an exact fit of the tool over the deck boards to be spaced. It is known that graded lumber vary in dimensions from one lift to another and from one sawmill to another. One lift of nominal 2"×6" lumber may have an actual individual width of 5-½" whereas another batch may have an individual width of 5-⅝", etc. Therefore, the use of a gauge block 22 made with a sample of the deck boards, mounted between the spacer blades 12 is advantageous for providing an accurate fit of the tool 10 over the deck boards, and consequently for providing a more efficient and accurate tool.

When the board spacing tool 10 is not used, it is easily taken apart and stowed in pieces in a tool box for example, with the handle 18 laid along the blades 12.

As to other manner of usage and operation of the board spacing tool according to the present invention, the same should be apparent from the the above description and accompanying drawings, and accordingly further discussion relative to the manner of usage and operation of the tool would be considered repetitious and is not provided.

While one embodiment of the present invention has been illustrated and described herein above, it will be appreciated by those skilled in the art that various modifications, alternate constructions and equivalents may be employed without departing from the true spirit and scope of the invention. For example, it will be appreciated that the tool according to the present invention can be used to space a number of separable objects other than boards and pieces of lumber, and such alternate use is limited only by the imagination of the user of the tool. It will be appreciated that any sample of a separable object that is attachable to the spacer blades of the tool according to the present invention can be used as a gauge block for spacing two or more juxtaposed separable objects. Therefore, the above description and the illustrations should not be construed as limiting the scope of the invention which is defined by the appended claims.

I claim:

1. A tool for spacing separable objects comprising:

two spacer blades, and an array of holes in each of said spacer blades for removably retaining said spacer blades to a gauge block, astride said gauge block, such that a gauge block having a specific width may be mounted to and between said spacer blades for use thereof in gauging separable objects having said specific width.

2. The tool as claimed in claim 1, further comprising a handle extending through each of said spacer blades.

3. The tool as claimed in claim 2, further comprising means for adjusting said spacer blades along said handle according to said specific width.

4. The tool as claimed in claim 3, wherein said handle is tubular in shape.

5. The tool as claimed in claim 4, wherein said means for adjusting said spacer blades comprises tube clamps mounted on said handle.

6. The tool as claimed in claim 2, wherein said handle in made of PVC conduit.

7. The tool as claimed in claim 1, wherein said spacer blades are made of a material selected from a group of materials comprising aluminum, plastic and plywood.

8. The tool as claimed in claim 1, wherein each of said spacer blades has a rounded tip.

9. A board spacing tool comprising:

two spacer blades each having a hole therein;

a handle movably mounted in said holes;

a gauge block mounted to and between said spacer blades adjacent said handle; said gauge block consisting of apiece of lumber, and means for removably retaining said spacer blades to said gauge block.

10. The board spacing tool as claimed in claim 9, further comprising means for adjusting a distance between said spacer blades according to a width of said gauge block.

11. The board spacing tool as claimed in claim 10, wherein said means for adjusting a distance between said spacer blades comprises tube clamps mounted on said handle.

12. The board spacing tool as claimed in claim 9 wherein said means for removably retaining said spacer blades to said gauge block comprise means for adjusting a position of said spacer blades relative to a surface of said gauge block.

13. The board spacing tool as claimed in claim 12 wherein said means for removably retaining. said spacer blades to said gauge block comprises an array of holes in each of said spacer blades.

14. The board spacing tool as claimed in claim 9, wherein each of said spacer blades has a rounded tip.

15. In combination, a deck under construction comprising juxtaposed deck boards, and a board spacing tool mounted on one of said deck boards, said board spacing tool comprising:

two spacer blades each having a hole therein;

a handle movably mounted in said holes;

a gauge block mounted to and between said spacer blades adjacent said handle; said gauge block consisting of a piece of said deck boards, and means for removably retaining said spacer blades to said gauge block.

16. The combination as claimed in claim 15, wherein said board spacing tool further comprises means for adjusting a distance between said spacer blades according to a width of said gauge block.

17. The combination as claimed in claim 16, wherein said handle of said board spacing tool is tubular.

18. The combination as claimed in claim 17, wherein said means for adjusting a distance between said spacer blades comprises tube clamps mounted on said handle.

19. The combination as claimed in claim 15 wherein said means for removably retaining said spacer blades to said gauge block comprise means for adjusting a position of said spacer blades relative to a surface of said gauge block.

20. The combination as claimed in claim 19 wherein said means for removably retaining said spacer blades to said gauge block comprises an array of holes in each of said spacer blades.

* * * * *